US005322546A

United States Patent [19]

Holsgrove et al.

[11] Patent Number: 5,322,546

[45] Date of Patent: Jun. 21, 1994

[54] FILTRATION OF MOLTEN MATERIAL

[75] Inventors: Peter Holsgrove, Alma, Canada; Luc Montgrain, Terre Haute, Ind.; Richard S. Bruski, Encinitas; Gary Hust, San Marcos, both of Calif.

[73] Assignee: Alcan International Limited, Montreal, Canada

[21] Appl. No.: 979,524

[22] Filed: Nov. 23, 1992

[51] Int. Cl.[5] ..... C22B 9/02

[52] U.S. Cl. ..... 75/407; 75/412; 266/227

[58] Field of Search ..... 266/227; 75/407, 412

[56] References Cited

U.S. PATENT DOCUMENTS 3,654,150 4/1972 Eccles ..... 75/412
3,840,364 10/1974 Flemings et al. ..... 75/407
5,114,472 5/1992 Eckert et al. ..... 75/412

*Primary Examiner*—Melvin J. Andrews
*Attorney, Agent, or Firm*—Gregory Garmong

[57] ABSTRACT

An apparatus for filtering molten material, such as a molten metal-ceramic particle mixture, includes a porous cloth filter located so that the mixture must pass through the cloth filter, and a mechanical filter shaker that prevents the accumulation of filtered solids on the porous cloth filter. Where a further degree of filtration is required, there is a second filter located so that material leaving the porous cloth filter passes through the second filter after it passes through the porous cloth filter, and a mechanism that prevents an accumulation of filtered solids on the second filter. The second filter is desirably a porous media filter.

23 Claims, 2 Drawing Sheets

FILTRATION OF MOLTEN MATERIAL

BACKGROUND OF THE INVENTION

This invention relates to metallurgical processing, and, more particularly, to the filtration of molten metal and composite materials to remove solid material therefrom.

According to one approach, cast composite materials may be formed by melting a metallic matrix alloy in a furnace and adding particulate matter to the molten metal. The mixture is vigorously mixed to encourage wetting of the matrix alloy to the particles, and after a suitable mixing time the mixture is cast into molds or forms. The mixing is conducted while minimizing the introduction of gas into the mixture. The resulting composite materials have the particulate reinforcement distributed throughout a matrix of an alloy composition.

Such cast composite materials are much less expensive to prepare than many other types of metal-matrix composite materials such as those produced by powder metallurgical technology and infiltration techniques. Composite materials produced by this approach, as described in U.S. Pat. Nos. 4,759,995, 4,786,467, and 5,028,392, have enjoyed commercial success in only a few years after their first introduction.

There are two types of solid matter that may be present in the composite material. A desirable particulate is the ceramic material intentionally added to the melt. This material is usually a carefully selected and sized ceramic. Typical types of ceramics are aluminum oxide and silicon carbide, and typical particle sizes are in the range of from about 5 up to about 35 micrometers. An undesirable solid matter is an uncontrolled material that finds its way into the melt during the production operation. The undesirable solid matter may include, for example, pieces of the ceramic furnace lining that have broken off during mixing, pieces of impellers that have broken off during mixing, pieces of molten-metal furnace troughs that have broken off into the flow metal, pieces of oxide films that have formed on the melt surface and been enfolded into the melt during mixing, and pieces of reaction products between the desirable particulate and the melt that have become free floating in the melt, such as aluminum carbides.

The undesirable solid matter is generally larger in size than the desirable particulate reinforcement, and may typically be on the order of 200 micrometers or more in maximum dimension (i.e., about 10 times the size of the desirable particulates). If left in the melt, the undesirable solid matter is frozen into the composite material when it solidifies. The undesirable solid matter becomes inclusions that can adversely affect the mechanical properties of the final composite material.

A similar problem is encountered in the more-conventional metallurgical industry that does not deal with composite materials. It has long been the practice to filter undesirable solid matter from melts of non-composite alloys that are to be used in sensitive applications. Different types of filters are used, depending upon the metal to be filtered and the cleanliness requirements of the product.

In aluminum alloy melting practice the molten alloy may be passed through a glass-fiber sock filter having an open weave so that there are openings of a predefined size in the filter. The solid matter is trapped at the surface of the filter. The filter openings are typically on the order of 400 micrometers or more in size, and are selected according to the cleanliness requirement of the final product and production considerations. Smaller openings remove smaller particles, resulting in a cleaner final product. On the other hand, the smaller the openings, the greater the flow resistance offered by the filter and the slower the filtration process. The filter may actually remove particles smaller than the filter mesh size due to the buildup of a filter cake. The filter size opening is usually selected to be a compromise between the requirements of metallurgical cleanliness and production efficiency.

Another type of filter used in the aluminum industry for filtering conventional (non-composite) alloys is the porous media filter. The porous media filter is a block of a material such as a ceramic that has a controlled open-cell porosity therethrough. Pieces of undesirable solid material are trapped within the volume of the filter as the molten alloy is passed through the filter.

In the course of the work leading to the present invention, conventional glass-fiber sock filters and porous media filters were used to filter molten mixtures of an aluminum alloy and 10–20 volume percent of desirable particulate such as alumina or silicon carbide, of a size distribution of about 5–20 micrometers. Coarse undesirable solid matter was mixed in to the melt. The conventional filtering practice could be used on a laboratory scale. However, it did not produce successful commercial-scale heats of the composite material. Variations of filter opening size were also tried, unsuccessfully. In short, conventional aluminum-alloy filtering practice was not operable with aluminum-based cast composite materials on a commercial scale.

There is therefore a need for an improved filtering technology for removing undesirable large solid pieces from composite material melts, while not affecting the distribution of smaller particles in the melt and the final product. The present invention fulfills this need, and further provides related advantages.

SUMMARY OF THE INVENTION

The present invention provides an apparatus and method of particular value in filtering melts of composite materials on a commercial scale, but which can also be used for filtering non-composite materials. The filtering approach removes large-size, undesirable solid pieces, but does not change the amount or distribution of the smaller, desirable particulates in the composite material. Metal flows through the filter at the full rate, throughout the entire course of the filtering of a commercial-scale heat. There is no plugging of the filter. The apparatus and method are readily implemented in commercial operations, without changing the basic metal melting, distribution, and casting equipment.

In accordance with the invention, an apparatus for filtering molten material comprises a molten material trough, a porous cloth filter located so that material flowing in the trough must pass through the filter, and means for preventing an accumulation of solids on the filter as material flows through the trough and the filter. In another embodiment, an apparatus for filtering molten material comprises a molten material trough, a porous media filter located so that material flowing in the trough must pass through the filter, and means for preventing an accumulation of solids on the porous media filter as material flows through the trough and the filter.

Common to these two embodiments is some means for preventing an accumulation of filtered solids on the surface of the filter. (As used herein, "filtered" solids are those solids that have not passed through a filter, but remain upstream of the filter or on the surface of the filter.) Where solids, here the undesired solid matter that is removed by the filter, are permitted to accumulate on the filter surface as a filter cake, that accumulation can quickly block the filter and prevent further flow of the metal through the filter. Thus, the filter plugs and production stops.

Conventional filters seem to work for small, laboratory scale filtering requirements, but are not acceptable for commercial scale work because the buildup of filter cake gradually reduces the metal flow rate and leads to plugging. Under the present approach, a buildup of solids is prevented, so that the filter is operable to remove large, but not small, solid pieces throughout the filtering operation, and plugging is avoided.

The prevention of an accumulation of solids is to be distinguished from the common approach of permitting filtered solids to accumulate and to remove them periodically. This removal is not easily done for molten metal filtration, but in any event the present approach does not permit an accumulation of solids.

Two techniques have been developed to prevent the accumulation of filtered solids on the surfaces of the filters. In one, of most interest for flexible porous cloth filters such as glass fiber sock filters, the filter is continuously shaken during the filtration operation. The shaking is preferably at a rate of about 0.1 to about 10 cycles per second, and with an amplitude of about ½ to 4 inches. In the other approach, of most interest for rigid filters such as porous media filters, an impeller is operated on the upstream side of the filter to stir and agitate filtered solids as they are removed from the metal. The filtered solids are retained in suspension upstream of the filter, so that they cannot settle on the filter and plug it. The filter is desirably oriented at an angle to the horizontal so that the solids cannot settle back onto the surface of the filter and instead gradually fall to a trap below the filter.

The single filters of the invention are operable to remove a fraction of the undesirable solid matter. To achieve a higher degree of cleanliness, two filters may be placed in a serial relation so that the molten material passes through each in turn. The first filter is sized to remove larger-size undesirable solid pieces, and the second filter is sized to remove smaller-sized undesirable solid pieces. Selection of the filter types depends upon factors such as the composition of the molten material.

The present invention has been demonstrated to provide good filtration for a variety of alloy types and cleanliness requirements. The filtration is achieved over long production filtering runs, which was not possible with the conventional filters. The final composite material product has a reinforcing particulate size, size distribution, and volume fraction substantially identical to the melted material in the furnace, but is freed of larger-sized, undesirable solid pieces such as broken furnace linings, surface oxides, and slag, for example. Filtration is achieved at acceptable commercial production rates.

The present invention therefore provides an important advance in the art of cast composite materials. High-quality, clean composite material is prepared by filtration in acceptable production quantities and rates. Other features and advantages of the present invention will be apparent from the following more detailed description of the preferred embodiment, taken in conjunction with the accompanying drawings, which illustrate, by way of example, the principles of the invention.

DETAILED DESCRIPTION OF THE INVENTION

Figure 1:
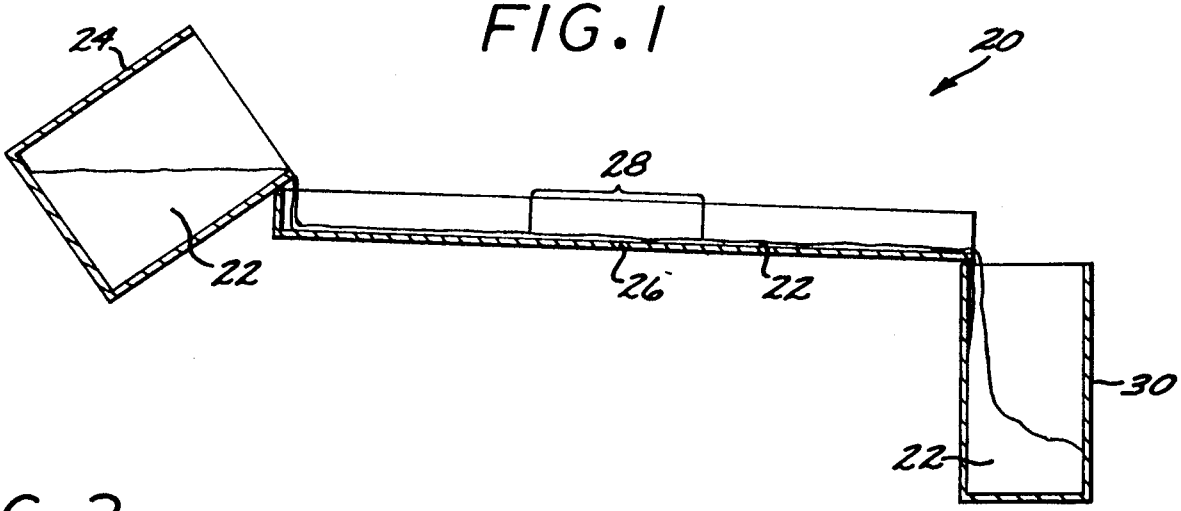
FIG. 1 is a schematic side sectional view of a foundry melting and casting operation.

FIG. 1 schematically depicts a melting and casting operation 20. A mixture 22 of desirable particulate and molten metallic alloy is prepared in a crucible 24. Any operable preparation and mixing procedures may be used. The preferred approach is as described in U.S. Pat. Nos. 4,759,995, 4,786,467, and 5,028,392, whose disclosures are incorporated by reference. When the mixture 22 is prepared, the crucible 24 is tilted and the flowable mixture is poured into a trough 26. The mixture flows along the trough, through one or more filters in a filtering zone 28, to be discussed in more detail subsequently, and into a mold 30. The molten metallic alloy solidifies in the mold 30, producing a cast composite material. The trough 26 is depicted as relatively short, but in commercial practice may be quite long and split into multiple troughs in order to convey the mixture to multiple molds 30. The metal may also be conveyed to other casting devices, such as a continuous caster. The present invention is concerned with the filtration of the composite material, and not with the details of mixing or solidification.

Figure 2:
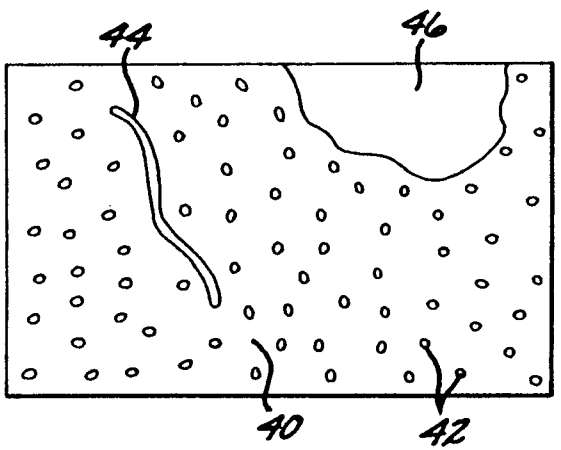
FIG. 2 is a drawing of a microstructure of an unfiltered cast composite material.

FIG. 2 is a drawing of the microstructure of a composite material that has not been filtered. The microstructure includes a matrix 40 and desirable small reinforcing particulate 42 distributed throughout the matrix 40. In this example, the matrix 40 is an aluminum-based alloy and the desirable particulate 42 is nearly spherical particles of aluminum oxide, silicon carbide, or other ceramic material of a size of 5–35 micrometers.

Also found in the matrix 40 are large, irregular undesirable pieces of solid matter 44 and 46. These pieces are typically much larger than the desirable particulate 42, and often 10–100 times as large or more. The undesirable solid pieces 44 can be of many types. The solid pieces can include, for example, oxide stringers 44 that formed on the surface of the melt in the crucible 24 and were enfolded into the melt during mixing or pouring. The solid matter may also include pieces of the refractory lining 46 of the crucible 24 or the trough 26 that break off during, mixing in the crucible or flow of the composite through the trough. Other types of undesirable solid pieces can also be present, and these two types are illustrated as exemplary.

It is to be understood that the amount of undesirable solid matter is not as great as suggested by FIG. 2, and that this drawing shows the solid matter in greater fraction than is conventional for the sake of illustration. However, even small amounts of the undesirable solid material can have highly adverse effects on final product properties far out of proportion to the amount present in the structure. The undesirable solids can cause premature cracking of the composite material during solidification or in service, and only a single premature crack can lead to failure of the composite material.

Figure 3:
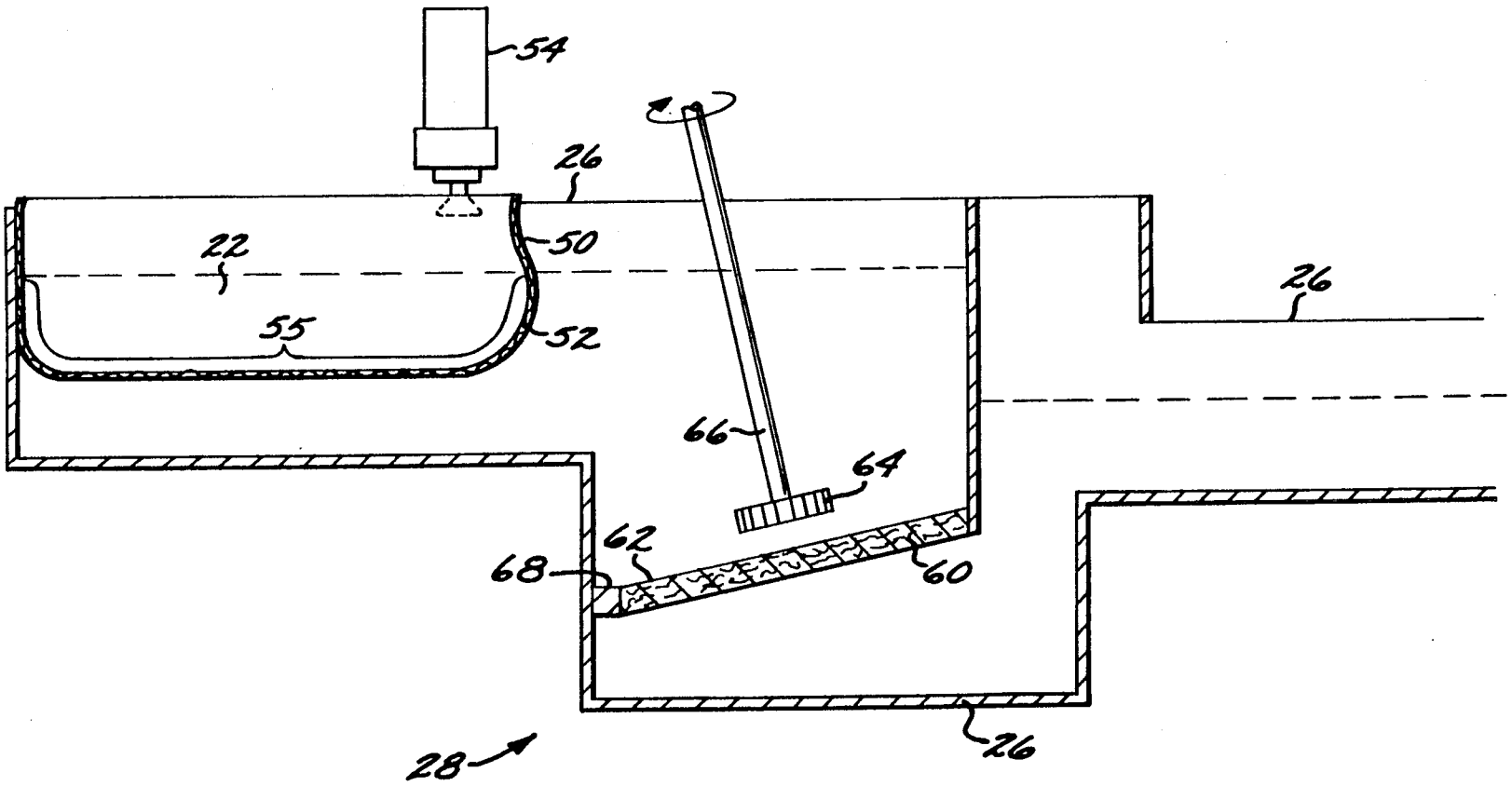
FIG. 3 is a schematic sectional view of the filtering zone of the melting and casting operation.

The undesirable solid matter is selectively removed from the matrix, leaving the desirable particulate 42 distributed throughout the matrix, by filtration in the filtration zone 28. FIG. 3 illustrates two preferred types of filters, here operated serially so that the mixture 22 first passes through one filter and then the other. The filters may also be operated singly, if preferred. The serial filtration produces a cleaner final composite product, with the production flow-through rate determined by the slower-flowing of the filters. In many applications, the use of a single filter is sufficient to provide the required degree of cleanliness. (As used herein, "cleanliness" of the composite is synonymous with the degree of absence of undesirable solids such as the particles 44 and 46.)

Referring to FIG. 3, the molten flowable mixture 22 is supplied from the melting-and-mixing crucible 24, which is out of view to the left of the drawing. The unfiltered mixture flows through the trough 26 and thence into and out of the filtering zone 28. After lzone 28. After leaving the filtering zone 28, the filtered mixture flows to the mold 30, which is out of view to the right of the drawing, for solidification.

A first filter 50 is formed of a porous cloth such as porous glass cloth, preferably shaped as a sock filter as shown. Porous glass cloth is widely used as a filter material in the aluminum industry, and is available commercially in a wide range of types and pore opening sizes. That is, the porous cloth can be ordered and purchased with a specified pore size, such as 400 micrometer, 500 micrometer, etc. size pores. Alternatively, the porous cloth can be purchased by specifying the number of openings per inch. In the present discussion, the glass cloth will be discussed in terms of pore size, and that is most easily compared with particle sizes. A useful porous glass filter for filtering molten aluminum-alloy composite material having about 5–35 volume percent reinforcement particles of size 5–35 micrometers has a pore size of about 0.3–1.0 millimeters.

In accordance with the present invention, there is provided means for preventing an accumulation of solids on an upstream side 52 of the porous cloth filter 50. In the preferred approach, the means for preventing is a mechanical vibrator or shaker 54 attached to the portion of the filter 50 that extends above the surface of the flowing mixture 22. The shaker 54 includes a motor and a mechanical linkage that causes the filter 50 to move back and forth relatively rapidly. The movement prevents undesirable solid matter from affixing itself to the upstream side 52 of the filter 50. Instead, large particles such as the refractory lining particles 46 that cannot pass through the porous cloth filter 50 remain suspended in the metal on the upstream side of the filter 50.

As a result of the vibration, a filtering region 55 of the filter 50 remains unclogged with filter cake or any other accumulation of separated solids. Thus, even after extending filtering as required in a commercial operation, the filtering region 55 responds as though the filtering operation has just commenced. The effective pore size of the filter 50 does not decrease and the filter does not become blocked, inasmuch as filtered solids remain in suspension on the upstream side 52 of the filtering region 55. The solids do not plug the filter 50, which would otherwise be the case in the conventional approach wherein the filtered solids are allowed to accumulate on the filter.

The important result of this use of a means for preventing an accumulation is that the flowthrough rate of the filter 50 does not decrease with increasing filtration time, and the filter does not become blocked with a filter cake. When solids are allowed to accumulate on the upstream side 52 of the filter 50 as in the conventional practice, this filter cake can slow the flowthrough rate and soon block the filter entirely.

Extensive experimentation has determined preferred amplitudes and frequencies for the shaking of the filter 50. The amplitude of vibration is preferably from about ½ to about 4 inches. Too small a vibration is unsuccessful in preventing accumulation of filtered solids, while too large a vibration can disrupt the flow of mixture 22 in the trough 26 and introduce gas into the mixture 22. The frequency of vibration is preferably from about 0.1 to about 10 cycles per second. Slower frequencies are unsuccessful in preventing the accumulation of solids, while higher frequencies can damage the filter, disrupt the mixture flow, and require overly large equipment. Lower frequencies are preferred for large opening sizes of the porous cloth, while higher frequencies are preferred for small opening sizes.

FIG. 3 also illustrates a second filter 60, which in this case is a rigid porous media filter. Such filters are used commercially in the aluminum industry to filter molten materials. They are available in a range of porosity sizes and materials of construction. In most instances, the porous media filters are made of ceramics such as phosphate-bonded alumina.

The porous media filter, sometimes known as a ceramic foam filter when made of ceramic, achieves filtration by a different filtration mechanism than the porous glass filter. The porous glass filter is essentially a sieve, while the porous media filter is a depth filter. The porous media filter permits material to enter the interior of the filter and pass through a tortuous porosity path. Undesirable solid matter is trapped within the interior of the filter, and the filter is thrown away after use. The porous media filter is particularly effective in capturing and removing elongated undesirable solid matter that otherwise typically slips through a porous cloth filter, such as the oxide stringers 44 of FIG. 2. The porous media filter usually has a maximum preferred metal flow rate, typically about 1 pound of aluminum alloy per minute per square inch of filter area. If there is an attempt to impose higher flow rates through the filter, entrapped solid matter may be forced through the filter and into the casting.

Although the porous media filter achieves filtration by a different mechanism than the porous cloth filter, in conventional practice large solid pieces in the mixture that has passed through the first filter 50 may accumulate on an upstream surface 62 of the filter 60. With an increasing amount of total metal flow through the filter as required in filtering commercial-size heats, the filter flowthrough rate falls and the filter becomes partially or totally blocked, much in the same manner as discussed for accumulations of solids on the porous cloth filter.

To avoid this effect, means for preventing an accumulation of solids on the upstream side 62 of the filter 60 is provided. To prevent the accumulation of solids on the upstream side 62 of the filter 60, an impeller 64 turning on a shaft 66 is positioned Just above the upstream side 62. The impeller 64 turns at a rate sufficiently high to prevent solids which have not passed into the filter 60 from settling onto the surface of the filter 60. The rate should not be so high as to create a vortex or enfold gas into the mixture 22, however. In practice, a rate of about 150 revolutions per minute has been found satisfactory. The impeller should not be close to contact with the filter surface, but is preferably about 1-2 inches from the surface of the filter. If the impeller is too close, it may tend to force filtered solids into the filter rather than maintain them in suspension. If the impeller is too far from the surface of the filter, it will be ineffective in maintaining the filtered solids in suspension upstream of the filter.

The filter 60 is preferably oriented at an angle to the horizontal, as shown in FIG. 3. In the illustration, the filter 60 is angled upwardly by about 15 degrees from the horizontal, but it could be more if desired. The upward angle of the filter 60 has two beneficial effects. Bubbles on the downstream side of the filter 60 are able to float upwardly and escape to the surface of the molten mixture. Also, solids on the upstream side 62 gradually settle toward the lower end of the filter to a collection region 68. In this location, the solids upstream of the filter are not repeatedly forced into the filter 60, and can be cleaned out when the casting run is complete and the used filter 60 is replaced with a new filter in preparation for the next run.

After passing through the filter 60, the flowable mixture flows along the remainder of the trough 26 to the casting station and into the mold.

Figure 4:
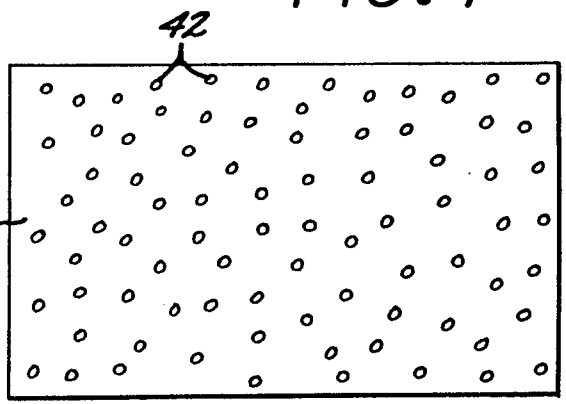
FIG. 4 is a drawing of a microstructure of a filtered cast composite material.

The resulting structure of the cast composite material is similar to that depicted in FIG. 4. The microstructure has only matrix 40 and the desirable particulate 42. The undesirable solid pieces in the form of stringers, refractory lining, and other types of solids are removed in the filter or filters.

Although a particular embodiment of the invention has been described in detail for purposes of illustration, various modifications may be made without departing from the spirit and scope of the invention. Accordingly, the invention is not to be limited except as by the appended claims.

What is claimed is:

1. Apparatus for filtering molten material, comprising:

a molten material trough;

a porous cloth filter located so that material flowing the trough must pass through the filter; and means for preventing an accumulation of solids on the filter as material flows through the trough and the filter, the means for preventing including continuously operating mechanical means for separating solids from the filter as the solids deposit upon the filter.

2. The apparatus of claim 1, wherein the filter is shaped as a sock.

3. The apparatus of claim 1, wherein the porous cloth filter is made of woven glass cloth.

4. The apparatus of claim 1, wherein the pore size of the porous cloth filter is from about 0.3 to about 1 millimeter.

5. The apparatus of claim 1, wherein the means for preventing an accumulation includes means for mechanically shaking the filter during the filtration process.

6. The apparatus of claim 5, wherein the means for mechanically shaking is operable to shake the filter at a rate of from about 0.1 to about 10 cycles per second.

7. The apparatus of claim 5, wherein the means for mechanically shaking is operable to shake the filter with an amplitude of from about ½ inch to about 4 inches.

8. Apparatus for filtering molten material comprising:

a molten material trough;

a porous cloth filter located so that material flowing in the trough must pass through the filter;

means for preventing an accumulation of solids on the filter as material flows through the trough and the filter; and a second filter located so that material flowing in the trough must pass through the second filter after it passes through the porous cloth filter.

9. Apparatus for filtering molten material, comprising:

a molten material trough;

a porous media filter located so that material flowing in the trough must pass through the filter, the porous media filter being oriented upwardly at an angle to the horizontal; and means for preventing an accumulation of solids on the porous media filter as material flows through the trough and the filter, wherein the means for preventing includes a stirring impeller located on an upstream side of the porous media filter.

10. The apparatus of claim 9, wherein the stirring impeller is located about 1 to about 2 inches from the surface of the porous media filter.

11. Apparatus for filtering molten material, comprising:

a molten material trough;

a porous cloth first filter located so that material flowing in the trough must pass through the first filter;

means for preventing an accumulation of filtered solids on the first filter as material flows through the trough and the first filter;

a second filter located so that material flowing in the trough must pass through the second filter after it passes through the first filter; and means for preventing an accumulation of filtered solids on the second filter as material flows through the trough and the second filter.

12. The apparatus of claim 11, wherein the first filter is a porous cloth filter and the means for preventing an accumulation of filtered solids on the first filter includes means for mechanically shaking the first filter.

13. The apparatus of claim 11, wherein the second filter is a porous media filter and the means for preventing an accumulation of filtered solids on the second filter includes a stirring impeller located on an upstream side of the porous media filter.

14. Apparatus for filtering molten material, comprising:

a molten material trough;

a porous cloth filter located so that material flowing in the trough must pass through the sock filter;

means for mechanically shaking the first filter during the filtration process;

a second filter located so that material flowing in the trough must pass through the second filter after it passes through the porous cloth filter; and means for preventing an accumulation of filtered solids on the second filter as material flows through the trough and the second filter.

15. The apparatus of claim 14, wherein the second filter is a porous media filter and the means for preventing an accumulation of filtered solids on the second filter includes a stirrer located on an upstream side of the porous media filter.

16. A method for filtering a molten composite material, comprising the steps of:

providing a mixture of ceramic particles distributed in a molten metal matrix, the ceramic particles including desirable reinforcing particles and also undesirable particles larger than the desirable reinforcing particles;

passing the mixture through a filter that removes the undesirable particles as filtered solids and passes the desirable particles; and preventing an accumulation of filtered solids on the filter as the mixture flows through the filter, the step of preventing including the step of mechanically agitating the filtered solids to prevent them from accumulating on the filter.

17. The method of claim 16, wherein the step of mechanically agitating includes the step of continuously shaking the filter as the molten metal mixture is passed through the filter.

18. The method of claim 16, wherein the step of mechanically agitating includes the step of continuously stirring the molten metal mixture immediately upstream of the filter as the molten metal mixture is passed through the filter.

19. The method of claim 16, wherein the step of passing the mixture through a filter includes the step of providing a porous cloth filter.

20. The method of claim 16, wherein the step of passing the mixture through a filter includes the step of providing a porous media filter.

21. The method of claim 16, including the additional step, after the step of passing the mixture through a filter, of passing the mixture through a second filter located downstream of the filter.

22. The method of claim 21, wherein the step of passing the mixture through a filter includes the step of providing a porous cloth filter, and wherein the step of passing the mixture through a second filter includes the step of providing a porous media second filter.

23. The method of claim 16, wherein the step of providing a mixture includes the step of providing desirable reinforcing particles of a particle size of from 5 to 35 micrometers.

* * * * *